US006345582B1

(12) United States Patent
Dudink

(10) Patent No.: US 6,345,582 B1
(45) Date of Patent: Feb. 12, 2002

(54) OUTRIGGER APPARATUS

(76) Inventor: Edward A. Dudink, 127 Huron Heights Dr., Newmarket, Ontario (CA), L3Y 4Z6

( * ) Notice: Subject to any disclaimer, the term of this patent is extended or adjusted under 35 U.S.C. 154(b) by 0 days.

(21) Appl. No.: 09/591,069

(22) Filed: Jun. 9, 2000

(51) Int. Cl.[7] ..... B63B 1/00; B63B 35/00

(52) U.S. Cl. ..... 114/61.15; 114/61.24; 114/347

(58) Field of Search ..... 114/61.24, 123, 114/347, 360, 61.15

(56) References Cited

U.S. PATENT DOCUMENTS

| | | | | | |
|---|---|---|---|---|---|
| 3,223,065 | A | * | 12/1965 | Wilson, Jr. | 114/39.26 |
| 3,304,899 | A | * | 2/1967 | Weatherly | 114/39.25 |
| 3,762,353 | A | * | 10/1973 | Shutt | 114/39.24 |
| 3,777,690 | A | * | 12/1973 | Garber | 114/39.22 |
| 4,303,033 | A | * | 12/1981 | King | 114/61.22 |
| 4,315,475 | A | * | 2/1982 | Echols | 114/61.24 |
| 4,512,277 | A | | 4/1985 | Williams | |
| 4,807,551 | A | | 2/1989 | Ace | |
| 4,875,426 | A | | 10/1989 | Soga et al. | |
| 4,915,047 | A | * | 4/1990 | Lord et al. | 114/39.26 |
| 4,926,776 | A | * | 5/1990 | Corbett | 114/263 |
| 4,977,844 | A | | 12/1990 | Barr | |
| 4,986,202 | A | * | 1/1991 | Mourgue et al. | 114/61.24 |
| 4,993,350 | A | * | 2/1991 | Pepper | 114/292 |
| 5,052,324 | A | * | 10/1991 | Lesly | 114/353 |
| 5,060,591 | A | * | 10/1991 | Ciavarra | 114/123 |
| D322,773 | S | | 12/1991 | Kissel et al. | |
| 5,237,954 | A | * | 8/1993 | Evans | 114/352 |
| 5,295,454 | A | | 3/1994 | Streck | |
| 5,582,126 | A | * | 12/1996 | Rypinski | 114/352 |

FOREIGN PATENT DOCUMENTS

| | | | | |
|---|---|---|---|---|
| CA | 499627 | * | 2/1954 | 114/123 |
| DE | 4318001 | * | 1/1994 | 114/123 |
| IT | 680775 | * | 1/1965 | 114/123 |

* cited by examiner

*Primary Examiner*—S. Joseph Morano
*Assistant Examiner*—Andrew D. Wright

(57) ABSTRACT

A outrigger apparatus for connecting a pontoon to a canoe and placing a platform therebetween. The outrigger apparatus includes a pontoon portion. A coupling means couples the pontoon portion to a canoe. The coupling means includes a pair of bars. Each of the bars is elongate, having a first end, and a second end. Each of the first ends of the bars is removably coupled to the top peripheral edge of the canoe. A pair of brackets removably couples the second ends of the bars to the pontoon portion. Each of the brackets is elongate, and each has a base portion and an arm portion. The base portions of the brackets are removably coupled to the pontoon portion. Each of the second ends of the bars is removably coupled to one of the brackets. A support portion supports the user. The support portion is a platform. The platform has a pair of opposing edges. Each of the opposing edges is rested on one of the bars.

11 Claims, 5 Drawing Sheets

FIG 5
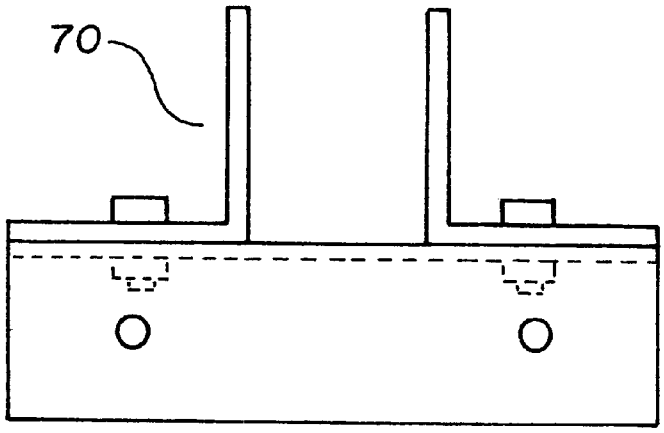
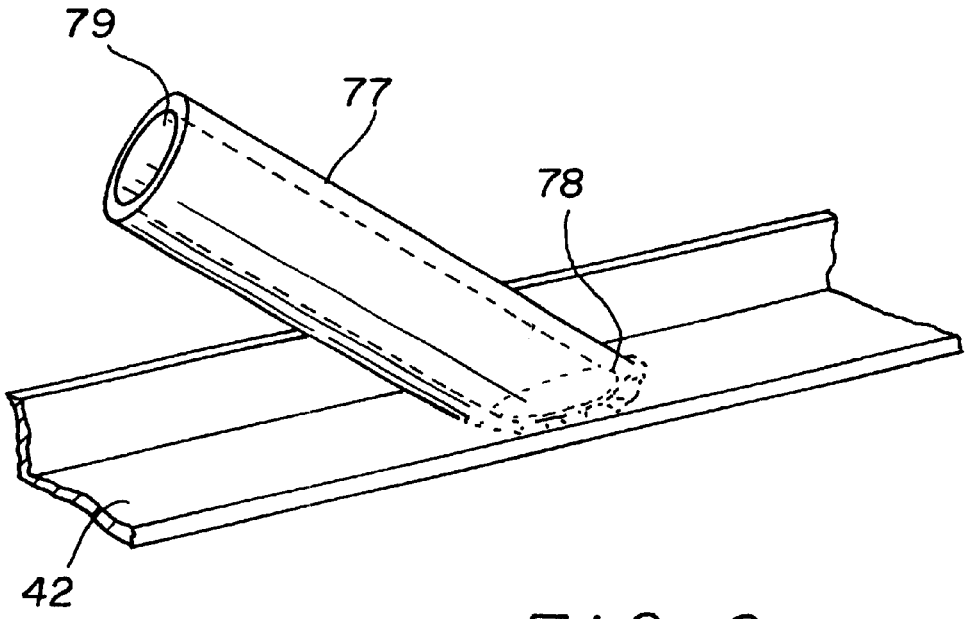
FIG 6

FIG 7
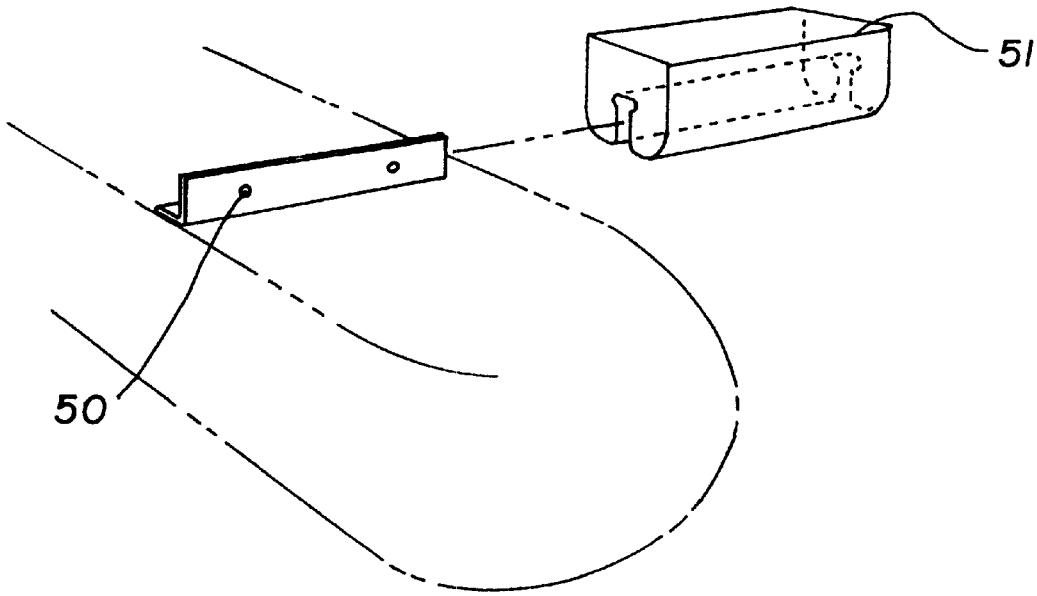
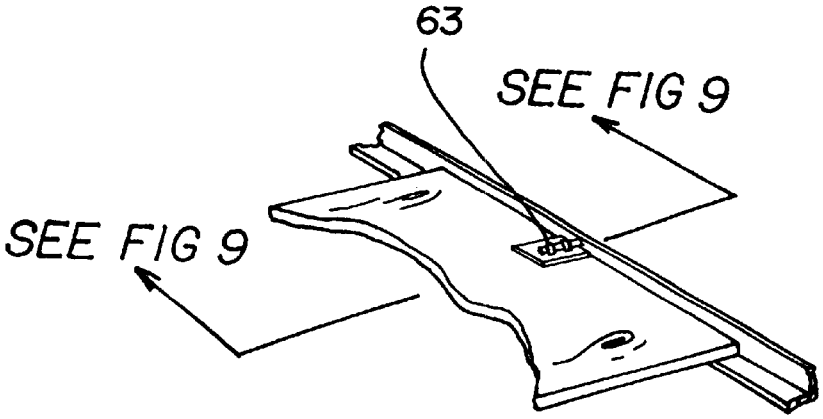
FIG 8

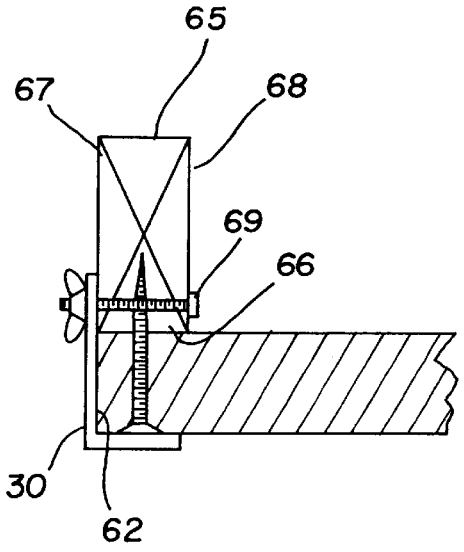
FIG. 9
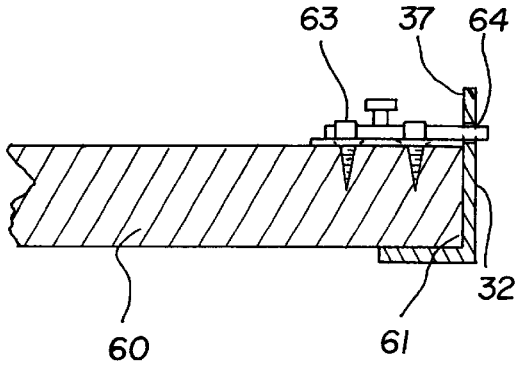

OUTRIGGER APPARATUS

BACKGROUND OF THE INVENTION

1. Field of the Invention

The present invention relates to outriggers and more particularly pertains to a new outrigger apparatus for connecting a pontoon to a canoe and placing a platform therebetween.

2. Description of the Prior Art

The use of outriggers is known in the prior art. More specifically, outriggers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,807,551; 4,512,277; 5,295,454; 4,875,426; U.S. Des. Pat. No. 322,773; and U.S. Pat. No. 4,977,844.

While these devices fulfill their respective, particular objectives and requirements, the aforementioned patents do not disclose a new outrigger apparatus. The inventive device includes a pontoon portion. A coupling means couples the pontoon portion to a canoe. The coupling means includes a pair of bars. Each of the bars is elongate, having a first end, and a second end. Each of the first ends of the bars is removably coupled to the top peripheral edge of the canoe. A pair of brackets removably couples the second ends of the bars to the pontoon portion. Each of the brackets is elongate, and each has a base portion and an arm portion. The base portions of the brackets are removably coupled to the pontoon portion. Each of the second ends of the bars is removably coupled to one of the brackets. A support portion supports the user. The support portion is a platform. The platform has a pair of opposing edges. Each of the opposing edges is rested on one of the bars.

In these respects, the outrigger apparatus according to the present invention substantially departs from the conventional concepts and designs of the prior art, and in so doing provides an apparatus primarily developed for the purpose of connecting a pontoon to a canoe and placing a platform therebetween.

SUMMARY OF THE INVENTION

In view of the foregoing disadvantages inherent in the known types of outriggers now present in the prior art, the present invention provides a new outrigger apparatus construction wherein the same can be utilized for connecting a pontoon to a canoe and placing a platform therebetween.

The general purpose of the present invention, which will be described subsequently in greater detail, is to provide a new outrigger apparatus apparatus and method which has many of the advantages of the outriggers mentioned heretofore and many novel features that result in a new outrigger apparatus which is not anticipated, rendered obvious, suggested, or even implied by any of the prior art outriggers, either alone or in any combination thereof.

To attain this, the present invention generally comprises a pontoon portion. A coupling means couples the pontoon portion to a canoe. The coupling means includes a pair of bars. Each of the bars is elongate, having a first end, and a second end. Each of the first ends of the bars is removably coupled to the top peripheral edge of the canoe. A pair of brackets removably couples the second ends of the bars to the pontoon portion. Each of the brackets is elongate, and each has a base portion and an arm portion. The base portions of the brackets are removably coupled to the pontoon portion. Each of the second ends of the bars is removably coupled to one of the brackets. A support portion supports the user. The support portion is a platform. The platform has a pair of opposing edges. Each of the opposing edges is rested on one of the bars.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new outrigger apparatus apparatus and method which has many of the advantages of the outriggers mentioned heretofore and many novel features that result in a new outrigger apparatus which is not anticipated, rendered obvious, suggested, or even implied by any of the prior art outriggers, either alone or in any combination thereof.

It is another object of the present invention to provide a new outrigger apparatus which may be easily and efficiently manufactured and marketed.

It is a further object of the present invention to provide a new outrigger apparatus which is of a durable and reliable construction.

An even further object of the present invention is to provide a new outrigger apparatus which is susceptible of a low cost of manufacture with regard to both materials and labor, and which accordingly is then susceptible of low prices of sale to the consuming public, thereby making such outrigger apparatus economically available to the buying public.

Still yet another object of the present invention is to provide a new outrigger apparatus which provides in the apparatuses and methods of the prior art some of the advantages thereof, while simultaneously overcoming some of the disadvantages normally associated therewith.

Still another object of the present invention is to provide a new outrigger apparatus for connecting a pontoon to a canoe and placing a platform therebetween.

Yet another object of the present invention is to provide a new outrigger apparatus which includes a pontoon portion. A coupling means couples the pontoon portion to a canoe. The coupling means includes a pair of bars. Each of the bars is elongate, having a first end, and a second end. Each of the first ends of the bars is removably coupled to the top peripheral edge of the canoe. A pair of brackets removably couples the second ends of the bars to the pontoon portion. Each of the brackets is elongate, and each has a base portion and an arm portion. The base portions of the brackets are removably coupled to the pontoon portion. Each of the second ends of the bars is removably coupled to one of the brackets. A support portion supports the user. The support portion is a platform. The platform has a pair of opposing edges. Each of the opposing edges is rested on one of the bars.

Still yet another object of the present invention is to provide a new outrigger apparatus that allows a motor to be mounted the platform for easy use by the operator.

Even still another object of the present invention is to provide a new outrigger apparatus that is lightweight for easy carrying.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a schematic side view of the motor mount of the present invention.

FIG. 6 is a schematic perspective view of the fishing rod holder of the present invention.

FIG. 7 is a schematic perspective view of the bracket coverings of the present invention.

FIG. 8 is a schematic perspective view of the fastening means of the platform of the present invention.

FIG. 9 is a schematic side view taken alone line 9—9 of the present invention.

DESCRIPTION OF THE PREFERRED EMBODIMENT

Figure 1:
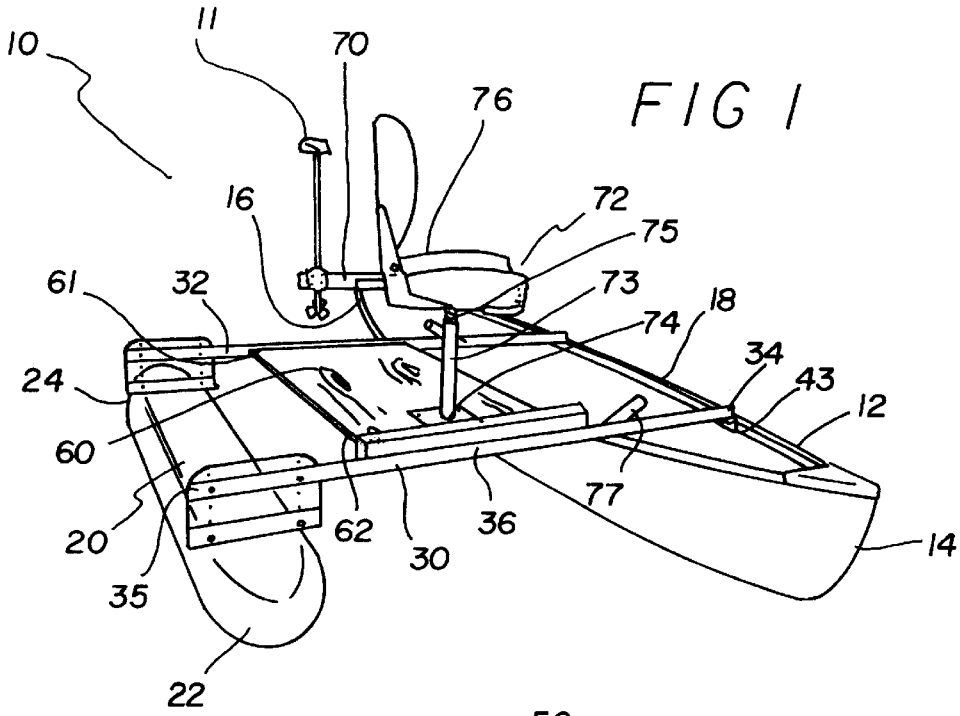
FIG. 1 is a schematic perspective view of a new outrigger apparatus according to the present invention.
Figure 2:
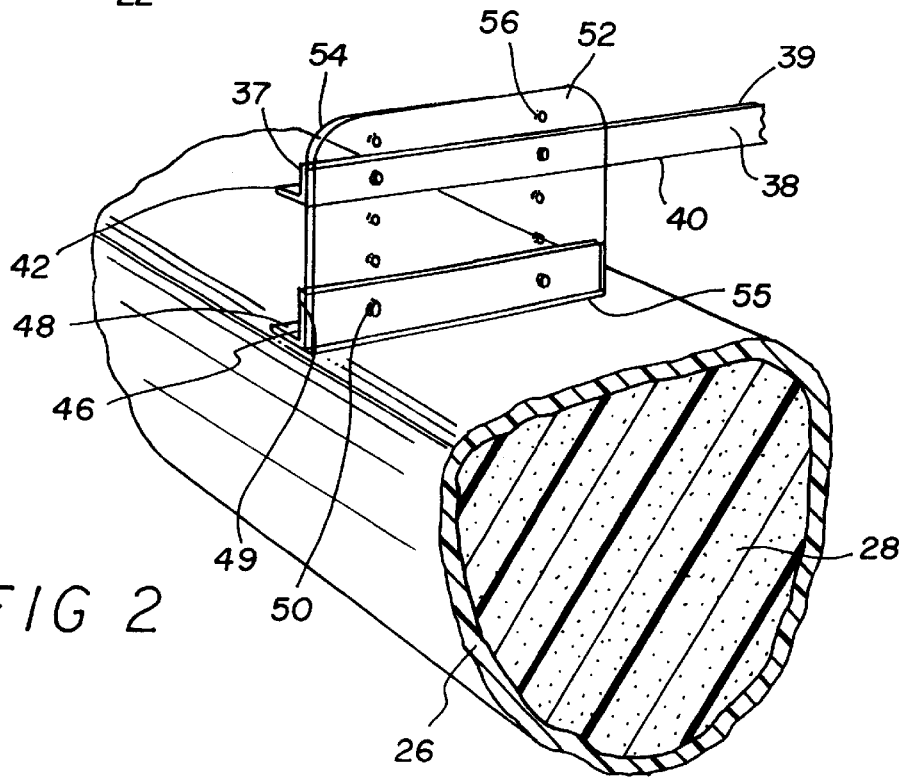
FIG. 2 is a schematic perspective view of the present invention.

With reference now to the drawings, and in particular to FIGS. 1 through 9 thereof, a new outrigger apparatus embodying the principles and concepts of the present invention and generally designated by the reference numeral 10 will be described.

As best illustrated in FIGS. 1 through 9, the outrigger apparatus 10 generally comprises a boat 12, pontoon portion 20 and coupling means for coupling the two together. The boat 12 is elongate and has a distal portion 14 and a proximal portion 16. The boat has a top peripheral edge 18 and is preferably a canoe.

The pontoon portion 20 has a front end 22 and a back end 24. A peripheral wall 26 extends between the front 22 and back 24 ends. The pontoon portion 20 has an inner core 28 comprising buoyant material such as a foamed plastic or elastomeric material. The peripheral wall 26 encompasses the inner core. The peripheral wall comprises water impermeable material which is preferably fiberglass. The front end 22 is ideally rounded.

Figure 3:
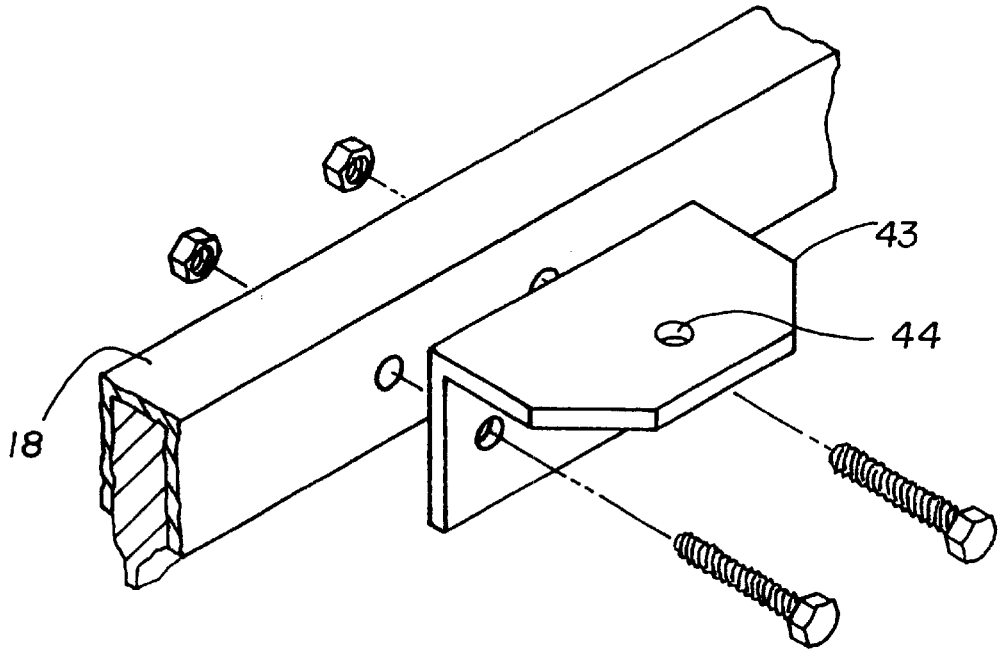
FIG. 3 is a schematic perspective view of brackets to hold the bars to the canoe of the present invention.

The coupling means couples the pontoon portion to the boat. The coupling means includes a pair of bars 30, 32. Each of the bars is elongate, having a first end 34, a second end 35, a middle portion 36, a facing side 37 and a back side 38. Each of the bars has a top edge 39 and a bottom edge 40. Each of a pair of lips 42 is integrally coupled to one of the bottom edges 40 of the bars. Each of the lips 42 extends away from the facing sides 37 of the bars. The lips 42 are orientated generally perpendicular to the facing sides 37. Each of the first ends 34 of the bars is removably coupled to the top peripheral edge 18 of the boat 12 using a bracket 43 as depicted in FIG. 3. The bracket 43 is attached to the canoe 12 adjacent to the top peripheral edge 18. A bolt, not shown, then extends upwardly through a bore 44 in the bracket 43 and into the bar. The first end 34 of a first 30 of the bars is positioned in the distal portion 14 of the boat 12, and the first end 34 of a second 32 of the bars is positioned in the proximal portion 16 of the boat 12.

A pair of brackets 46 removably couples the second ends 35 of the bars to the pontoon portion 20. Each of the brackets 46 is elongate, and each of the brackets is generally L-shaped taken transverse to a longitudinal axis of the brackets. The brackets each have a base portion 48 and an arm portion 49, each of the base 48 and arm 49 portions has bores 50 therein. Each of the base portions 48 of the brackets 46 is removably coupled to the pontoon portion 20. A first of the brackets is located generally adjacent to the first end of the pontoon portion 22, and a second of the brackets is located generally adjacent to the second end 24 of the pontoon portion. The brackets 46 have a longitudinal axis orientated generally perpendicular to a longitudinal axis of the pontoon portion 20. A pair of coverings 51, preferably made from a foamed elastomeric material, covers the brackets 46 for loading on the tops of vehicles.

A pair of height adjustment means 52 adjusts the height of the bars with respect to the pontoon portion. Each of the height adjustment means 52 is a plate. Each of the plates, or height adjustment means 52, has a front side 54 and a bottom edge 55. The plates 52 have a plurality of pairs of bores 56 therein. Each of the pairs of the bores 56 generally lie along a line which is orientated parallel to the bottom edge 55 of the plate 52. Each of the plates 52 is removably mounted to one of the arm portions 49 of the first and second brackets 46 such that the bottom edge 55 of the plates 52 are generally positioned adjacent to the pontoon portion 20 and the front sides 54 of the plates 52 are abutted against the arm portions 49 of the brackets 46.

Each of the bars 30, 32 is removably coupled to one of the plates 52 such that the lips 42 on the arms extend toward each other. Bolts, not shown, extend through the bars 30, 32 and into the bores 56 in the plates 52. The pontoon portion 20 and the boat 12 are spaced apart from each other and orientated generally parallel to each other.

A support portion 60 supports the user. The support portion is a platform. The platform 60 has a pair of opposing edges 61, 62, and each of the opposing edges is rested on one of the lips 42 of the bars 30, 32. The platform 60 is preferably plywood.

A fastening means 63 fastens a first 61 of the opposing edges to the facing side 37 of the second bar 32. The fastening means 63 comprises a bolt. The bolt is slidably coupled to a top side of the platform 60. The bolt is generally adjacent to the first opposing edge 61 of the platform 60, and is selectively insertable into a bore 64 in the facing side 37 of the second bar 32.

Figure 4:
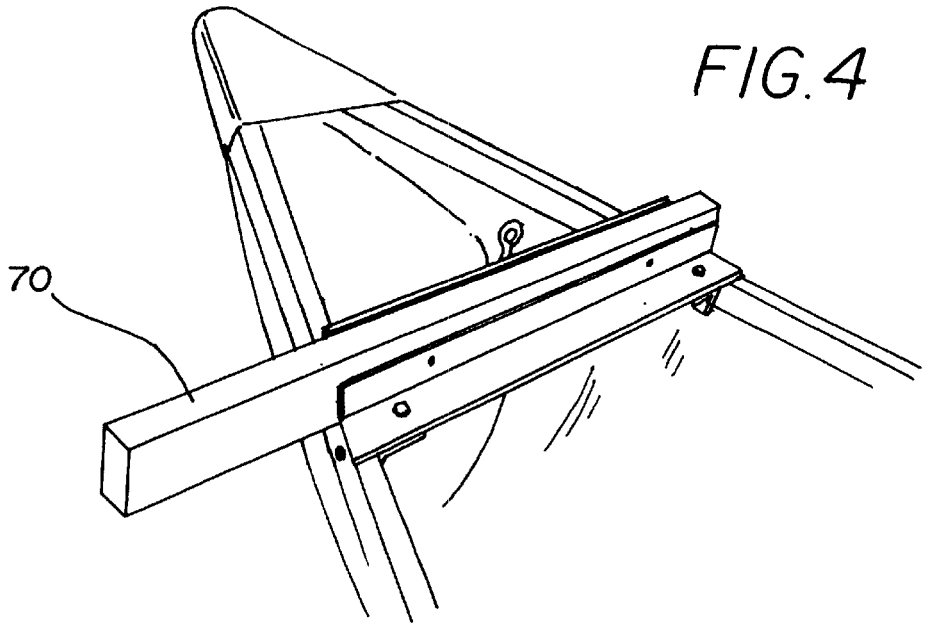
FIG. 4 is a schematic perspective view of the motor mount for the canoe of the present invention.

A motor mount comprises a wall 65. The wall 65 has a bottom edge 66, a first side 67 and a second side 68. The bottom edge 66 of the wall 65 is abutted against and fixedly secured to the top side of the platform 60. The wall 65 is generally adjacent to a second opposing edge 62 of the platform 60. A fastening means extends through the bar 30 and the first 67 and second sides 68 of the wall 65. The fastening means is a bolt 69. A second motor mount 70, depicted in FIGS. 4 and 5, is mounted in the proximal portion of the canoe.

A seating device 72 comprises a post 73 and chair 76. The post 73 has a first end 74 a second end 75. The first end 74 is fixedly coupled to the platform 60. The first end 74 is positioned generally adjacent to the motor mount wall 65. A bottom side of the chair 76 is rotatably coupled to the second end 75 of the post.

A plurality of fishing rod holders 77 holds the handle portions of fishing rods. Each of the fishing rod holders 77 has a first end 78 and a second end 79. Each of the fishing rod holders 77 is elongate and hollow. Each the first ends 78 of the fishing rod holders 77 is integrally coupled to the lips 42 of the bars 30, 32. The plurality of fishing rod holders 77 is ideally two fishing rod holders.

In use, the bars 30, 32 are coupled to the canoe 12 and then to the pontoon 20. The second ends 35 of the bars can be raised or lowered with respect to the pontoon such that the bars are level. The platform 60 is placed on the lips 42 of the bars 30, 32 and secured in place. A motor 11 can be attached to the canoe 12 or on the platform 60 adjacent to the chair 76 so that the boat may be maneuvered while the user is seated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An outrigger system for supporting a person, said system for mounting to a canoe having a distal portion, a proximal portion and a top peripheral edge, said system comprising:

a pontoon portion;

a coupling means for coupling said pontoon portion to said canoe, said coupling means comprising:

a pair of bars, each of said bars being elongate, each of said bars having a first end, and a second end, each of said first ends of said bars being removably coupled to the top peripheral edge of the canoe;

a pair of brackets for removably coupling said second ends of said bars to said pontoon portion, each of said brackets being elongate, each of said brackets having a base portion and an arm portion, each of said base portions of said brackets being removably coupled to said pontoon portion, each of said second ends of said bars being removably coupled to one of said brackets;

a support portion for supporting the user, said support portion being a platform, said platform having a pair of opposing edges, each of said opposing edges being rested on one of said bars;

said pontoon portion having a front end and a back end a peripheral wall extending between said front and back ends, said pontoon portion having an inner core, said inner core comprising buoyant material, said peripheral wall encompassing said inner core;

each of said bars having a facing side and a back side, each of said bars having a top edge and a bottom edge, each of said bars having a lip extending therefrom, said lips being integrally coupled to said bottom edges and extending away from said facing sides of said bars, said lips being orientated generally perpendicular to said facing sides, said first end of a first of said bars being positioned in said distal portion of said canoe, said first end of a second of said bars being positioned in said proximal portion of said canoe, wherein said platform being rested on said lips of said bars;

a pair of height adjustment means for adjusting the height of said bars with respect to said pontoon portion, each of said height adjustment means being a plate, each of said plates having a front side and a bottom edge, each of said plates having a plurality of pairs of bores therein, each of said pairs of said bores generally lying along a line being orientated parallel to said bottom edge of said plate, each of said plates being removably mounted to one of said arm portions of said first and second brackets such that said bottom edge of said plates are generally positioned adjacent to said pontoon portion and said front sides of said plates are abutted against said arm portions of said brackets; and a seating device, said seating device comprising a post and chair, said post having a first end a second end, said first end being fixedly coupled to said platform, a bottom side of said chair being rotatably coupled to said second end of said post.

2. The outrigger system as in claim 1, further comprising:

a fastening means for fastening a first of said opposing edges of said platform to said facing side of said second bar, said fastening means comprising a bolt, said bolt being slidably coupled to a top side of said platform, said bolt being generally adjacent to a first of a pair of opposing edges of said platform, said bolt being selectively insertable into a bore in said facing side of said second bar, each of said opposing edges being adjacent to one of said lips of said bar.

3. The outrigger system as in claim 1, further comprising:

a motor mount, said motor mount comprising a wall, said wall having a bottom edge, a first side and a second side, said bottom edge of said wall being abutted against and fixedly secured to said top side of said platform, said wall being generally adjacent to one of said bars.

4. The outrigger system as in claim 1, further comprising:

a plurality of fishing rod holders for holding the handle portions of fishing rods, each of said fishing rod holders having a first end and a second end, each of said fishing rod holders being elongate and hollow, each said first ends of said fishing rod holders being integrally coupled to said bars.

5. An outrigger system for supporting a person, said system comprising:

a boat, said boat being elongate having a distal portion and a proximal portion, said boat having a top peripheral edge, said boat comprising a canoe;

a pontoon portion, said pontoon portion having a front end and a back end, a peripheral wall extending between said front and back ends, said pontoon portion having an inner core, said inner core comprising buoyant material, said peripheral wall encompassing said inner core, said peripheral wall comprising water impermeable material, said peripheral wall comprising fiberglass, said front end being rounded;

a coupling means for coupling said pontoon portion to said boat, said coupling means comprising:

a pair of bars, each of said bars being elongate, each of said bars having a first end, a second end, a middle portion, a facing side and a back side, each of said bars having a top edge and a bottom edge, each of said bars having a lip extending therefrom, said lips being integrally coupled to said bottom edges and extending away from said facing sides of said bars, said lips being orientated generally perpendicular to said facing sides, each of said first ends of said bars being removably coupled to said top peripheral edge of said canoe, said first end of a first of said bars being positioned in said distal portion of said canoe, said first end of a second of said bars being positioned in said proximal portion of said boat;

a pair of brackets for removably coupling said second ends of said bars to said pontoon portion, each of said brackets being elongate, each of said brackets being generally L-shaped taken transverse to a longitudinal axis of said brackets, each of said brackets having a base portion and an arm portion, each of said base and arm portions having bores therein, each of said base portions of said brackets being removably coupled to said pontoon portion, a first of said brackets being located generally adjacent to said first end of said pontoon portion, a second of said brackets being located generally adjacent to said second end of said pontoon portion, each of said brackets having said longitudinal axis being orientated generally perpendicular to a longitudinal axis of said pontoon portion;

a pair of height adjustment means for adjusting the height of said bars with respect to said pontoon portion, each of said height adjustment means being a plate, each of said plates having a front side and a bottom edge, each of said plates having a plurality of pairs of bores therein, each of said pairs of said bores generally lying along a line being orientated parallel to said bottom edge of said plate, each of said plates being removably mounted to one of said arm portions of said first and second brackets such that said bottom edge of said plates are generally positioned adjacent to said pontoon portion and said front sides of said plates are abutted against said arm portions of said brackets;

wherein each of said bars are removably coupled to said plates such that said lips on said arms extend toward each other, said pontoon portion and said boat portion being spaced and orientated generally parallel to each other;

a support portion for supporting the user, said support portion being a platform, said platform having a pair of opposing edges, each of said opposing edges being rested on one of said lips of said bars;

a fastening means for fastening a first of said opposing edges to said facing side of said second bar, said fastening means comprising a bolt, said bolt being slidably coupled to a top side of said platform, said bolt being generally adjacent to said first opposing edge of said platform, said bolt being selectively insertable into a bore in said facing side of said second bar;

a motor mount, said motor mount comprising a wall, said wall having a bottom edge, a first side and a second side, said bottom edge of said wall being abutted against and fixedly secured to said top side of said platform, said wall being generally adjacent to a second opposing edge of said platform, a fastening means extending through said bar and said first and second sides of said wall, said fastening means being a bolt;

a seating device, said seating device comprising a post and chair, said post having a first end a second end, said first end being fixedly coupled to said platform, said first end being positioned generally adjacent to said motor mount, a bottom side of said chair being rotatably coupled to said second end of said post; and a plurality of fishing rod holders for holding the handle portions of fishing rods, each of said fishing rod holders having a first end and a second end, each of said fishing rod holders being elongate and hollow, each said first ends of said fishing rod holders being integrally coupled to said lips of said bars, said plurality of fishing rod holders being two fishing rod holders.

6. An outrigger system for supporting a person, said system for mounting to a canoe having a distal portion, a proximal portion and a top peripheral edge, said system comprising:

a pontoon portion;

a coupling means for coupling said pontoon portion to said canoe, said coupling means comprising:

a pair of bars, each of said bars being elongate, each of said bars having a first end, and a second end, each of said first ends of said bars being removably couplable to the top peripheral edge of the canoe;

a pair of brackets for removably coupling said second ends of said bars to said pontoon portion, each of said brackets being elongate, each of said brackets having a base portion and an arm portion, each of said base portions of said brackets being removably coupled to said pontoon portion, each of said second ends of said bars being removably coupled to one of said brackets;

a support portion for supporting the user, said support portion being a platform, said platform having a pair of opposing edges, each of said opposing edges being rested on one of said bars, said platform having a top side;

a motor mount, said motor mount comprising a wall, said wall having a bottom edge, a first side and a second side, said bottoms edge of said wall being abutted against and fixedly secured to said top side of said platform, said wall being generally adjacent to one of said bars; and a pair of height adjustment means for adjusting the height of said bars with respect to said pontoon portion, each of said height adjustment means being a plate, each of said plates having a front side and a bottom edge, each of said pairs having a plurality of pairs of bores therein, each of said pairs of said bores generally lying along a line being orientated parallel to said bottom edge of said plate, each of said plates being removably mounted to one of said arm portions of said first and second brackets such that said bottom edge of said plates are generally positioned adjacent to said pontoon portion and said front sides of said plates are abutted against said arm portions of said brackets.

7. The outrigger system as in claim 6, wherein said pontoon portion further comprises:

said pontoon portion having a front end and a back end, a peripheral wall extending between said front and back ends, said pontoon portion having an inner core, said inner core comprising buoyant material, said peripheral wall encompassing said inner core.

8. The outrigger system as in claim 6, wherein said bars further comprise:

each of said bars having a facing side and a back side, each of said bars having a top edge and a bottom edge, each of said bars having a lip extending therefrom, said lips being integrally coupled to said bottom edges and extending away from said facing sides of said bars, said lips being orientated generally perpendicular to said facing sides, said first end of a first of said bars being positionable in said distal portion of said canoe, said first end of a second of said bars being positionable in said proximal portion of said canoe, wherein said platform being rested on said lips of said bars.

9. The outrigger system as in claim 8, further comprising:

a fastening means for fastening a first of said opposing edges to said facing side of said second bar, said fastening means comprising a bolt, said bolt being slidably coupled to a top side of said platform, said bolt being generally adjacent to a first of a pair of opposing edges of said platform, said bolt being selectively insertable into a bore in said facing side of said second bar, each of said opposing edges being adjacent to one of said lips of said bar.

10. The outrigger system as in claim 6, further comprising:

a seating device, said seating device comprising a post and chair, said post having a first end a second end, said first end being fixedly coupled to said platform, a bottom side of said chair being rotatably coupled to said second end of said post.

11. The outrigger system as in claim 6, further comprising:

a plurality of fishing rod holders for holding the handle portions of fishing rods, each of said fishing rod holders having a first end and a second end, each of said fishing rod holders being elongate and hollow, each said first ends of said fishing rod holders being integrally coupled to said bars.

* * * * *